US011066789B2

(12) United States Patent
Darscheid

(10) Patent No.: US 11,066,789 B2
(45) Date of Patent: Jul. 20, 2021

(54) GROUND COMPACTION ROLLER AND METHOD FOR PRODUCING AN OSCILLATION CHARACTERISTIC OF A GROUND COMPACTION ROLLER

(71) Applicant: BOMAG GmbH, Boppard (DE)

(72) Inventor: Manfred Darscheid, Emmelshausen (DE)

(73) Assignee: BOMAG GmbH, Boppard (DE)

( * ) Notice: Subject to any disclaimer, the term of this patent is extended or adjusted under 35 U.S.C. 154(b) by 128 days.

(21) Appl. No.: 16/477,215

(22) PCT Filed: Dec. 22, 2017

(86) PCT No.: PCT/EP2017/001444
§ 371 (c)(1),
(2) Date: Oct. 1, 2019

(87) PCT Pub. No.: WO2018/130262
PCT Pub. Date: Jul. 19, 2018

(65) Prior Publication Data

US 2020/0048845 A1 Feb. 13, 2020

(30) Foreign Application Priority Data

Jan. 11, 2017 (DE) ..... 10 2017 000 193.6

(51) Int. Cl.
*E01C 19/28* (2006.01)

(52) U.S. Cl.
CPC ..... *E01C 19/286* (2013.01)

(58) Field of Classification Search
CPC ..... E01C 19/286
(Continued)

(56) References Cited

U.S. PATENT DOCUMENTS 3,878,733 A * 4/1975 Tertinek ..... E02D 3/074 404/113
4,577,995 A * 3/1986 Sadahiro ..... B06B 1/16 172/40

(Continued)

FOREIGN PATENT DOCUMENTS

| | | |
|---|---|---|
| EP | 0 530 546 A1 | 3/1993 |
| WO | 0244475 A1 | 6/2002 |
| WO | 2015101407 A1 | 7/2015 |

OTHER PUBLICATIONS

European Patent Office, International Search Report and Written Opinion of the International Searching Authority, International Application No. PCT/EP2017/001444, dated May 30, 2018 (12 pages).

*Primary Examiner* — Raymond W Addie
(74) *Attorney, Agent, or Firm* — Wood Herron & Evans LLP

(57) ABSTRACT

The present invention relates to a ground compaction roller, comprising a machine frame with an operator platform, a drive engine, at least one roller drum, said at least one roller drum being mounted for rotation between two mounting arms arranged at its face sides and connected to the machine frame, an exciter unit for generating oscillations arranged inside said at least one roller drum, said exciter unit having an exciter housing, two imbalance weights mounted inside said exciter housing for rotation in opposite directions and coupled to one another, said imbalance weights rotating about two rotation axes that are stationary relative to said exciter housing, and a drive motor arranged outside said exciter housing, said drive motor being in drive connection with at least one of said two rotatably mounted imbalance weights, and to a method for producing an oscillation image of a ground compaction roller, in particular a tandem roller.

13 Claims, 3 Drawing Sheets

(58) Field of Classification Search
USPC ..... 404/113, 117
See application file for complete search history.

(56) References Cited

U.S. PATENT DOCUMENTS

| | | | | | |
|---|---|---|---|---|---|
| 4,647,247 | A * | 3/1987 | Sandstrom | E01C 19/286 | 404/75 |
| 5,248,216 | A | 9/1993 | Vural | | |
| 6,132,133 | A * | 10/2000 | Muro | E01C 19/286 | 180/9.46 |
| 6,561,729 | B1 * | 5/2003 | Potts | E01C 19/286 | 404/117 |
| 6,655,871 | B1 * | 12/2003 | Riedl | B06B 1/166 | 404/113 |
| 8,393,825 | B2 * | 3/2013 | Marsolek | E01C 19/286 | 404/117 |
| 8,770,887 | B1 * | 7/2014 | Geier | E01C 19/28 | 404/117 |
| 2004/0028472 | A1 * | 2/2004 | Richter | E01C 19/286 | 404/117 |

* cited by examiner

GROUND COMPACTION ROLLER AND METHOD FOR PRODUCING AN OSCILLATION CHARACTERISTIC OF A GROUND COMPACTION ROLLER

CROSS-REFERENCE TO RELATED APPLICATIONS

This application is a submission under 35 U.S.C. § 371 of International Application No. PCT/EP2017/001444, filed Dec. 22, 2017, which claims priority to German Application No. 102017000193.6, filed Jan. 11, 2017, the disclosures of which are hereby expressly incorporated by reference herein in their entireties.

FIELD OF THE INVENTION

The present invention relates to a ground compaction roller and a method for producing an oscillation image of a ground compaction roller.

OF THE INVENTION

Generic ground compaction rollers are employed wherever a compaction of the underlying ground over a relatively large area is desired. For this, such ground compaction rollers comprise a machine frame with an operator platform from which the roller is operated, a drive engine, typically a diesel engine, via which the drive power required for operation of the roller is provided, and at least one roller drum. A roller drum typically comprises an essentially hollow-cylindrical drum shell and supplemental support members, for example plate washers, etc.

The at least one roller drum is normally mounted for rotation about a horizontal rotation axis transverse to the forward direction between two mounting arms arranged at the face sides. The mounting arms are connected to the machine frame at least partially rigidly in the case of articulated-steered rollers and via a pivot joint in the case of pivot-steered rollers.

To increase the efficiency of the compaction process, it is further known to arrange oscillation exciters, hereinafter also referred to as exciter unit, for generating oscillations inside the at least one roller drum. Such an oscillation exciter of the directed oscillator type is disclosed, for example, in EP 0 530 546 B1. The exciter unit comprises an exciter housing as well as two imbalance weights mounted for rotation in opposite directions inside the exciter housing and coupled to one another.

The coupling may be implemented, for example, via engagement of two gearwheels attached to the face sides of the imbalance weights. The imbalance weights can rotate about two rotation axes that are stationary relative to the exciter housing. A drive motor, typically a hydraulic motor, which is arranged outside the exciter housing, is in drive connection with at least one of the two rotatably mounted imbalance weights to drive the rotational movement of the two imbalance weights. The drive motor or drive connection may be designed such that both imbalance weights are driven directly through the drive connection with the drive motor, or such that a serial drive connection is provided in which one imbalance weight, which is in drive connection with the drive motor, drives the rotation of the imbalance weight connected downstream, for example, via the already described gearwheels at the face sides. The two imbalance weights are thus positively coupled.

In order to make the compaction spectrum of such a ground compaction roller as versatile as possible, the exciter housing of such ground compaction rollers is usually configured to be rotatable in its entirety relative to the machine frame so as to provide for an ideally continuous adjustment between an oscillatory movement generated by the exciter unit in a horizontal direction or in a vertical direction, depending on the maximum adjustment range. Although this configuration has already proven extremely successful, this solution involves relatively high manufacturing costs.

One aspect of the present invention is therefore to provide a ground compaction roller that can be manufactured in a cost-effective manner and at the same time exhibits an adequate oscillation behavior which, in particular, also preserves the ground.

SUMMARY OF THE INVENTION

In a generic ground compaction roller, the exciter housing is rotationally fixed relative to the mounting arms, and the two imbalance weights are coupled to one another in such a manner that their amplitudes add up in a horizontal direction.

Unlike the prior art described above, the present invention according to one embodiment is thus focused on preventing the conventional and normally desired adjustability of the exciter unit relatively to the machine frame through the rotationally fixed connection of the exciter unit. As a result, the relative position of the coupled imbalance weights is fixed with respect to the machine frame or at least relative to the mounting arms (in pivot-steered rollers), specifically in such a manner that their amplitudes add up in a horizontal direction. The imbalance weights thus rotate about a respective rotation axis in opposite directions in a manner coordinated such that their amplitudes cancel each other out in a vertical direction and add up in a horizontal direction, in particular, in and against the forward direction of the roller. This means that the phase positions of the imbalance weights are mandatorily fixed such that during the rotation process one imbalance weight rotates downward while the other imbalance weight rotates upward in an opposite direction, and vice versa. The vertical components of the rotation run in the same direction in space in this process.

In sum, an exclusively horizontal directed oscillator is obtained which generates essentially only horizontal oscillations. Variation options with regard to the oscillation characteristic can therefore be obtained only via the rotational speed and/or the distribution of the imbalance masses of the two positively coupled imbalance weights.

In contrast to the prior art, however, a spatial adjustment of the added amplitude from the horizontal orientation to a vertical orientation is not possible. In this manner, the relatively complicated and cost-intensive adjusting mechanism, which used to be required for adjusting the exciter housing of a directed oscillator, becomes superfluous. At the same time, a compacting oscillation is obtained that is sufficient for many applications and, in particular, preserves the ground surface.

The exciter unit is preferably configured such that the two rotation axes of the two imbalance weights extend horizontally and transversely to the forward direction and one above the other in a vertical direction. The two imbalance weights are thus positioned vertically one above the other and running parallel at least with respect to their rotation axes. Further, the two imbalance weights advantageously have same imbalance masses and also same mass distributions with respect to their respective rotation axis. As a result, the two imbalance weights can be configured essentially identical, so that the manufacturing costs can be reduced further.

The specific configuration of the rotationally fixed connection of the exciter housing to the mounting arms may vary. A rotary lock connecting the exciter housing to at least one of the two mounting arms is preferably used. The rotary lock is ideally designed such that it enables a rotational movement of the exciter housing relative to said at least one of the two mounting arms, in particular via form-locking members. The rotary lock is preferably configured such that it creates a form lock towards both sides of the direction of the revolving movement of the drum about its rotation axis, in particular inside, at the level of or at least in the immediate axial vicinity of the at least one mounting arm.

The rotary lock is preferably configured in the form of an insert shaft extending through a drum bearing, which insert shaft is guided out of the interior space of the drum, in particular, on a face side opposite a drive face side of the at least one roller drum. A drive face side in this case designates a face side of the roller drum via which the exciter unit is driven. For this, a suitable hydraulic motor is preferably arranged on a mounting arm at a face side of the roller drum, in particular, at the level of or coaxial with the rotation axis of the roller drum. This does therefore not concern the travel drive of the roller drum, which is frequently obtained through travel drive units, in particular hydraulic motors, that are attached on both sides of the roller drum. The insert shaft is thus arranged on the side of the drum opposite the drive motor of the exciter unit. This facilitates, in particular, the positioning of the drive motor for the exciter unit.

The insert shaft is ideally arranged between two flange plates, one of said flange plates being fixed, in particular directly flanged, to the exciter housing, and the other flange plate being fixed, in particular directly flanged, to the mounting arm. With the aid of the flange plates, a sufficiently stable connection of the insert shaft to the exciter housing and the mounting arm is achieved.

The insert shaft further preferably comprises a circumferential toothing arranged at least at its end, ideally on both sides, said circumferential toothing being arranged in a corresponding complementary internal toothing, for example, on one or both of the two flange plates. This enables a reliable insertion-type rotary lock in a simple manner. Additionally or alternatively, the insert shaft is further preferably mirror-symmetrical to facilitate its installation.

To prevent the vibrations generated by the exciter unit from being transferred directly to the machine frame, the mounting arms are preferably configured such that they comprise an absorber stage at least between an external part and an internal part, the exciter housing in this case being connected to the internal part in a rotationally fixed manner via a rotary lock, in particular, directly. Such an absorber stage may consist, for example, in one or more parallel rubber buffers or the like. The external part of the mounting arm comprises the part which is oriented towards the machine frame and which, in the case of articulated-steered-rollers, is ideally rigidly connected to the machine frame and, in the case of pivot-steered rollers, is at least indirectly connected to the pivot joint. The internal part of the respective mounting arm, on the other hand, designates the part which is arranged downstream of the absorber stage from the machine frame and to which the exciter housing is mounted at least indirectly. In one configuration, the aforesaid flange plate is flanged, in particular screwed, directly to the internal part of the respective mounting arm.

A further advantage of the present invention is that the configuration and arrangement of the exciter unit, according to one embodiment of the present invention, are also suitable for operation in a so-called split roller drum having two roller drum halves without problems and, in particular, without additional adaptation efforts. Split roller drums are known and common in the prior art. Especially in connection with exciter units, however, the two roller drum halves frequently require the use of relatively complicated synchronization mechanisms. In the present configuration, this is irrelevant, so that a robust and reliable operation even of a split roller drum is possible. This results in the advantage that, with regard to the configuration and mounting of the exciter unit, one and the same basic configuration can be used in non-split and split roller drums.

In one configuration, the exciter unit extends into both roller drum halves in the axial direction of the rotation axis of the at least one roller drum, more preferably in the axial direction of the rotation axis to equal extents with respect to the two imbalance weights. In this manner, a relatively homogeneous distribution of the oscillation effect of the exciter unit over both roller drum halves is achieved. Additionally or alternatively, the two roller drum halves may further have the same extension in the axial direction of the rotation axis of the at least one roller drum. In other words, the hollow-cylindrical drum shells of the two roller drum halves have the same cylinder height. Also, additionally or alternatively, the split roller drum having two roller drum halves further comprises only that one exciter unit with two imbalance weights for generating oscillations according to one embodiment. This also simplifies the overall structure of the roller drum.

In a configuration according to one embodiment of the present invention, the roller includes a further roller drum and is, in particular, an articulated-steered or pivot-steered tandem roller. Such rollers are known in the prior art in terms of their basic structure and are particularly suitable for the configuration described above.

The further roller drum then advantageously comprises a further exciter unit to also improve the compaction process of this drum with the aid of oscillations generated by the exciter unit according to one embodiment. The further exciter unit is in this case configured such that, compared to the exciter unit described above, in which the amplitudes of the two imbalance weights add up horizontally and cancel each other out vertically, said further unit generates a different oscillation characteristic, wherein an exciter unit which at least temporarily generates a vertical component during operation is provided. This achieves a combination of the horizontal directed oscillator as described above with an exciter unit which additionally introduces, at least partially, oscillations having a vertical component into the underlying ground. Through this combination, an advantageous compaction result can be obtained according to one embodiment.

The further exciter unit may be a so-called rotary exciter. A rotary exciter is characterized by including only one single imbalance mass rotating about a rotation axis, ideally a rotation axis which extends horizontally and transversely to the forward direction. Such rotary exciters are generally also known in the prior art and are, in particular, characterized by their simple structure and their high robustness.

To enable a reliable operation of the roller according to one embodiment of the present invention, a coordination device is provided which coordinates the operation of the two exciter units relative to one another, in particular, with regard to their frequency and/or phase position. To this end, the coordination device may include suitable sensors, in particular rotation sensors, for example, at the respective drive motors, as well as a control unit which controls the operation of at least one of the two drive motors of the two exciter units and in this manner enables a suitable coordinated operation.

A further aspect of the present invention also consists in a method for producing an oscillation image of a ground compaction roller, in particular an oscillation image suitable for ground-preserving compaction. The term 'oscillation image' in the present context designates the overall oscillation behavior of the two roller drums in relation to the underlying ground or essentially the sum of the two exciter units combined in the method according to one embodiment of the present invention, i.e., the horizontal directed oscillator and a further, in particular, different type of exciter unit. The present invention is particularly suitable for use in a tandem roller. According to one embodiment of the present invention, during a traversal of the underlying ground to be compacted, the steps of A) generating an exclusively horizontal oscillation, i.e., an oscillation having an exclusively horizontal amplitude, in a first drum, in particular, with the aid of the horizontal directed oscillator described above, and B) generating a different type of oscillation, in particular, with a vertical component, in a second drum, are performed simultaneously. The generation of a different type of oscillation having a vertical component thus designates an oscillation characteristic in which an at least partially vertically acting compaction force is also introduced into the underlying ground at least transitionally. In total, the machine thus provides a type of oscillation behavior in which, as a sum of both drums, diagonally acting compaction forces are also introduced into the underlying ground at least temporarily. This may be desired by users for certain compaction tasks.

In a modification of the method according to one embodiment of the present invention, generating the exclusively horizontal oscillation especially for a split roller drum having two roller drum halves, for example, as described above for the roller according to one embodiment of the present invention, is performed exclusively via one single exciter unit, more specifically the horizontal directed oscillator described above. This method is characterized in that it provides a simple and reliable way to generate horizontal oscillations even for a split roller drum.

Generally, the method according to one embodiment of the present invention is carried out using a roller according to the present invention.

BRIEF DESCRIPTION OF THE DRAWINGS

The present invention will be described in more detail below based on the embodiment examples illustrated in the figures. In the schematic figures.

Like components are designated by like reference numerals in the figures, although recurring components are not necessarily designated in each figure.

DETAILED DESCRIPTION OF THE INVENTION

Figure 1:
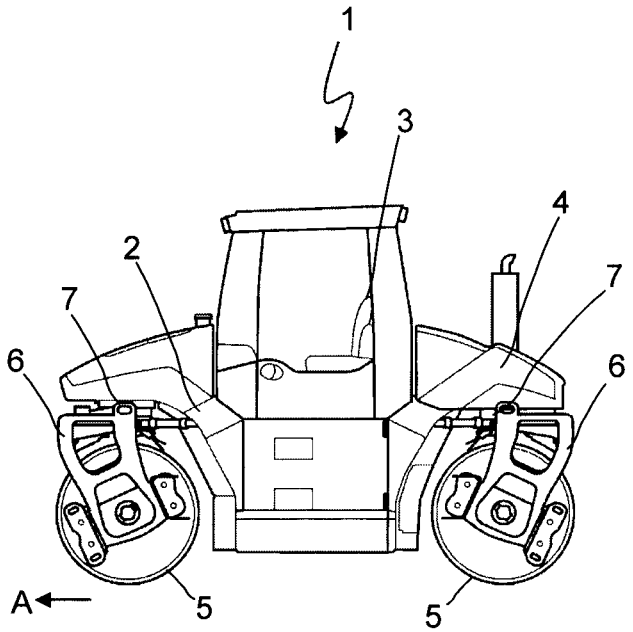
FIG. 1 is a side view of a pivot-steered tandem roller.
Figure 2:
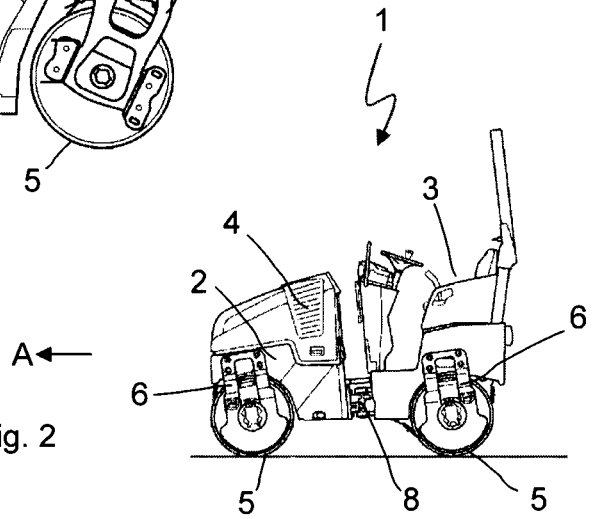
FIG. 2 is a side view of an articulated-steered tandem roller.
Figure 3:
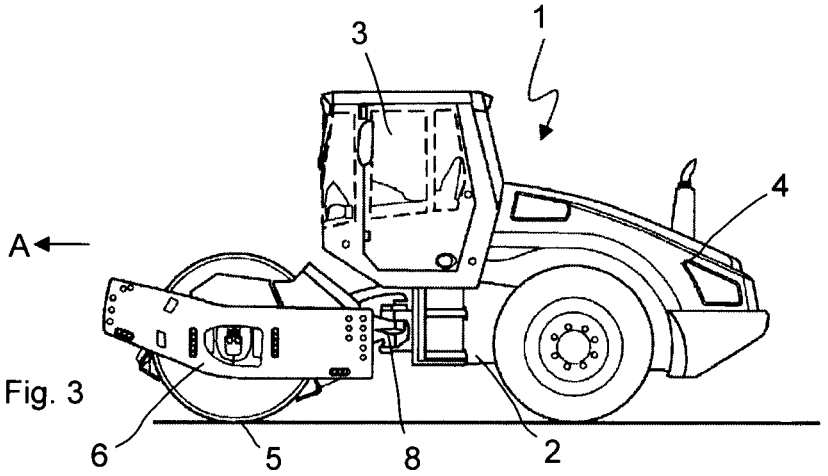
FIG. 3 is a side view of a single-drum roller.

FIGS. 1, 2 and 3 illustrate the general basic structure of various generic rollers 1. FIG. 1 shows a roller 1 of the pivot-steered tandem roller type. Elements of this roller 1 include a machine frame 2, an operator platform 3, a drive engine 4, and exclusively one front and one rear drum 5. The roller drums 5 are mounted via two lateral mounting arms 6 and are rotatable about a rotation axis that extends horizontally and transversely to the forward direction A, although only the left mounting arm 6 facing the viewer is visible in FIGS. 1-3. The roller drums 5 are steerable relative to the machine frame 2 about an essentially vertical steering axis via a pivot joint 7. A respective hydraulic motor (not shown in the figures) is provided as travel drive unit for the roller drums 5. The rollers of FIGS. 2 and 3 show a very similar basic structure, so that the following discussion focuses on existing differences and reference is otherwise made to the discussion of the roller 1 of FIG. 1.

In contrast to FIG. 1, FIG. 2 shows an articulated-steered tandem roller. In this variant, the machine frame 2 comprises two frame halves (front and rear frame halves) which are connected to each other via an articulated joint 8. The mounting arms 6 are rigidly connected to the machine frame 2 at least with their portion facing the latter.

FIG. 3 finally shows a roller 1 of the single-drum roller type. Again, the machine frame 2 comprises two frame halves, i.e., the front carriage and the rear carriage, which are connected via a pivot joint 8. In contrast to the two previously described rollers 1, the single-drum roller merely comprises one single roller drum 5 and a pair of rear wheels 9. Each of the rollers 1 of FIGS. 1-3 is self-propelled and comprises an exciter unit in at least one of their provided roller drums 5, as described in more detail in the following figures.

Figure 4:
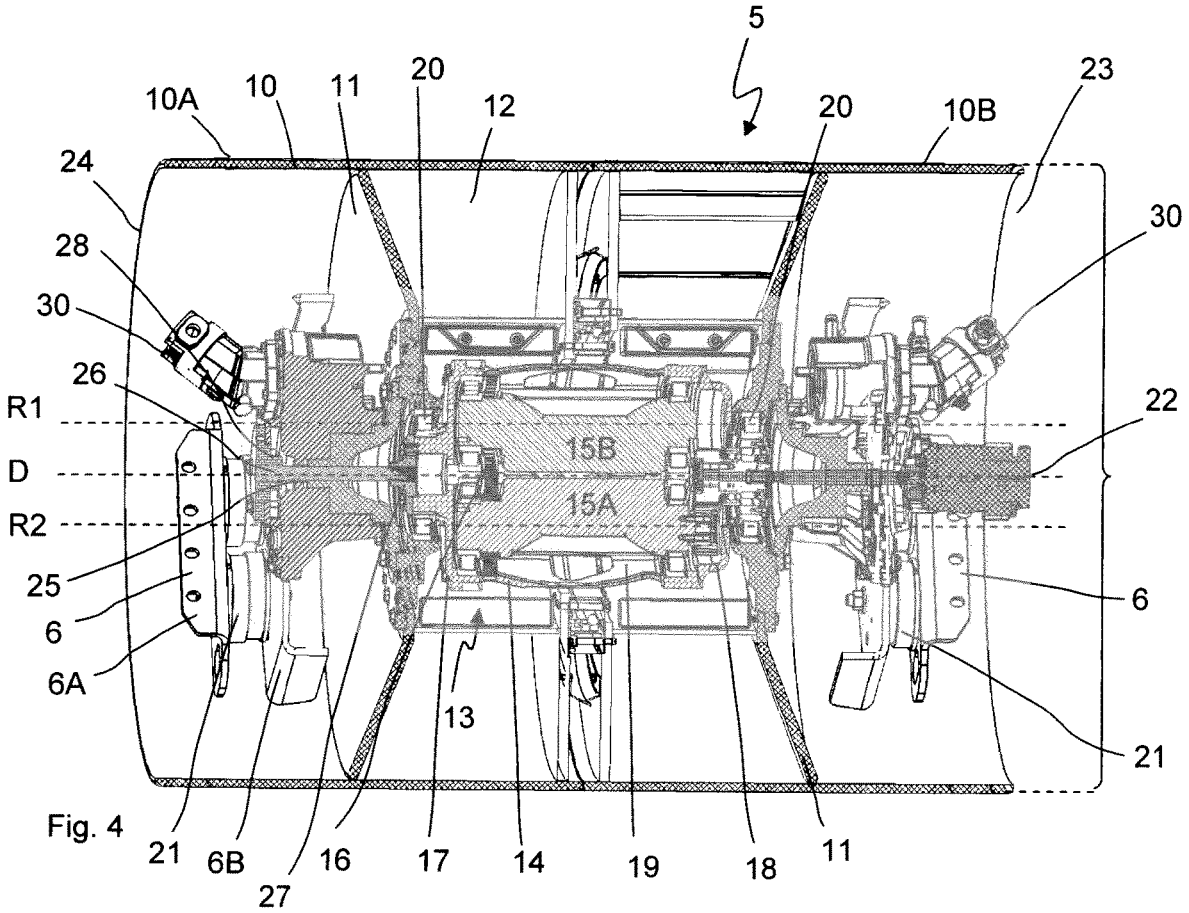
FIG. 4 is a perspective longitudinal cross section of a roller drum of any of the rollers of FIGS. 1-3.

For further description of the structure of at least one of the roller drums 5 of the rollers 1 of FIGS. 1-3, reference is first made to FIG. 4. Said figure shows a vertical longitudinal cross section along the rotation axis D in a slightly perspective oblique view. Elements of the roller drum 5 include a hollow-cylindrical drum shell 10 having two drum shell halves 10A and 10B. FIG. 4 thus shows a two-part roller drum 5, although the configuration and mounting of the exciter unit as described in more detail below may also be used for non-split roller drums.

The interior space 12 of the roller drum 5, which is delimited in the longitudinal direction of the rotation axis D by the two plate washers 11, contains only a single exciter unit 13 arranged therein, said unit comprising an exciter housing 14 having an interior space in which two imbalance weights 15A and 15B are arranged for rotation about a rotation axis R1 and R2, respectively. The two imbalance weights 15A and 15B are in engagement with one another at their face sides via a pair of gearwheels 16. Accordingly, the rotational movement of the two imbalance weights 15A and 15B is reverse relative to one another, and the imbalance weights rotate about the rotation axis R1 and R2, respectively, in opposite directions in a positively coupled manner during operation. The rotation axes R1 and R2 in this case extend parallel to one another and also parallel to the rotation axis D and one above the other in a vertical direction. A drive motor 22, in the present case a hydraulic motor, is provided for driving the rotational movement of the two imbalance weights 15A and 15B. The roller drum 5 thus comprises exclusively said single exciter unit 13.

The exciter unit 14 comprises a respective faceplate 17, 18 on both sides along the rotation axis D and further comprises a housing cylinder 19 which spans the imbalance weights in the direction of their rotation axes R1 and R2 between the faceplates 17 and 18, said housing cylinder not being continuously closed in the present embodiment example. The exciter unit 13 is mounted in a rotationally fixed manner with respect to the mounting arms 6, which are only partially shown in FIG. 4. This means that the drum shell 10 can rotate relative to the exciter unit 13, for example, via bearings 20, but is essentially stationary and rotationally fixed relative to the mounting arms 6. Each of the mounting arms 6 comprises an external part 6A and an internal part 6B, which are connected to each other via absorber members 21 to minimize a transfer of oscillations generated by the exciter unit 13 during operation to the machine frame 2, to which the external part 6A of the mounting arms is connected in the manner described in connection with FIGS. 1-3. To this end, a rotary lock 25 having an insert shaft 26 is provided on the face side 24 of the roller drum 5, or at said side, which is the side opposite the face side 23 of the roller drum 5 where the drive motor 22 for driving the exciter unit 13 is arranged. One end of the insert shaft 26 sits, in a rotationally fixed manner, in a flange plate 27 flanged to the faceplate 17 of the exciter housing 14. From there, the insert shaft 26 extends, coaxially to the rotation axis D, through a bearing of the roller drum 5 at the mounting arm 6 and terminates, in a rotationally fixed manner, in a flange plate 28 which, coming from outside, is flanged to the internal part 6B of the mounting arm 6. This prevents any rotational movement of the exciter housing 14 relative to the mounting arm 6. To this end, the insert shaft has form-locking members for creating a rotary lock at least in the axle shaft region in which it terminates in a respective one of the two flange plates 27, 28, said form locking members being, in particular, members with stop faces acting in the circumferential direction of the rotation axis D, for example a circumferential external toothing. These form-locking members are in engagement with complementary form-locking members in the respective flange plates 27, 28, which may be implemented, for example, using an internal toothing complementary to the external toothing of the insert shaft. The rotary lock may alternatively also be obtained through friction grip, for example, via a suitable knurl, in particular, on the insert shaft, etc.

On the face side 23 opposite the rotary lock 25, the exciter unit 13 is in drive connection with the drive motor 22 via a shaft 29. The shaft 29 is linked to one of the imbalance weights 15A, 15B via a gearwheel connection. The other imbalance weight is driven via the meshing gearwheel pair 16 attached to the imbalance weights 15A and 15B.

The imbalance weights 15A and 15B are arranged inside the exciter unit 15 in such a manner that their amplitudes add up in a horizontal direction and cancel each other out in a vertical direction during rotation operation about the rotation axes R1 and R2. Thus, if the exciter unit 13 is put into operation in the roller drum 5 according to FIG. 4, the roller drum 5, and, in particular, its two roller drum halves 10A and 10B, is loaded with horizontally oriented oscillations. This is specifically accomplished by a configuration in which the imbalance masses of the imbalance weights, which are located radially external to the rotation axes R1 and R2, rotate towards each other coming from above and below in reverse directions, and, in a horizontal direction, rotate in the same direction in space. All in all, this arrangement thus produces a horizontal directed oscillator having an exclusively horizontal overall amplitude.

FIG. 4 further illustrates that a respective travel drive motor 30, specifically a respective hydraulic motor, is further provided on the external sides of both roller drum halves 10A and 10B.

Figure 5:
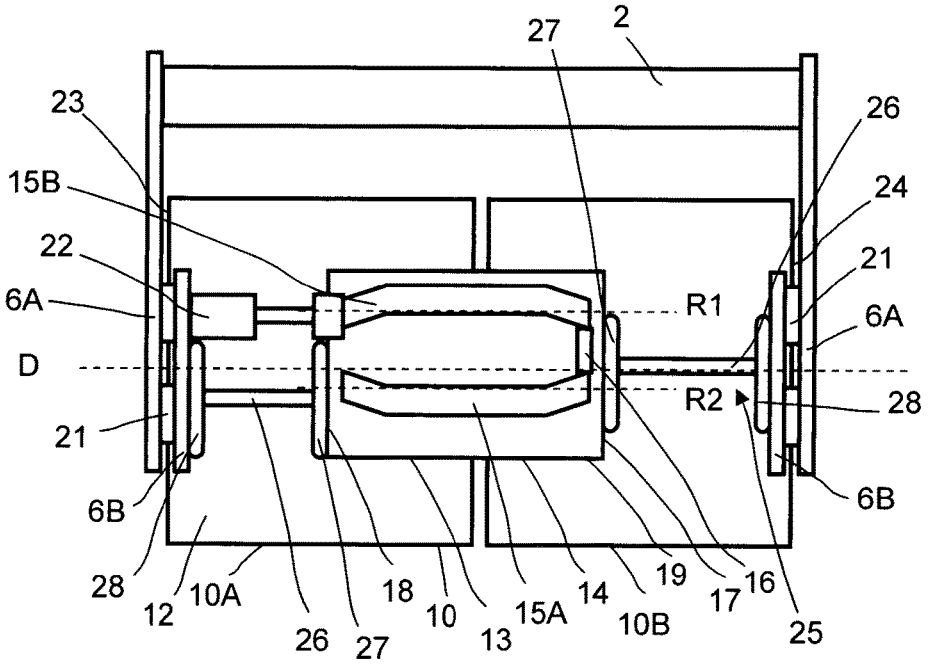
FIG. 5 is a longitudinal cross section of a roller drum in a basic diagram.

FIG. 5 reflects the basic structure described in FIG. 4 in a basic diagram in a slightly modified form, and reference is made, in particular, to the discussion of FIG. 4 for describing FIG. 5. What is important here is that, in particular, FIG. 5 illustrates clearly that a respective insert shaft 26 for creating a rotary lock with the corresponding flange plates 27 an 28 is provided on both sides of the exciter unit 13 in the direction of the rotation axis D. FIG. 5 further illustrates the linkage of the mounting arms 6 to the machine frame 2 via their respective external part 6A, although, as already described above, a pivot joint may alternatively also be interposed here. The roller drum halves 10A and 10B are rotatable about the rotation axis D relative to the mounting arms 6B via a rotary joint that is not illustrated in more detail.

Figure 6:
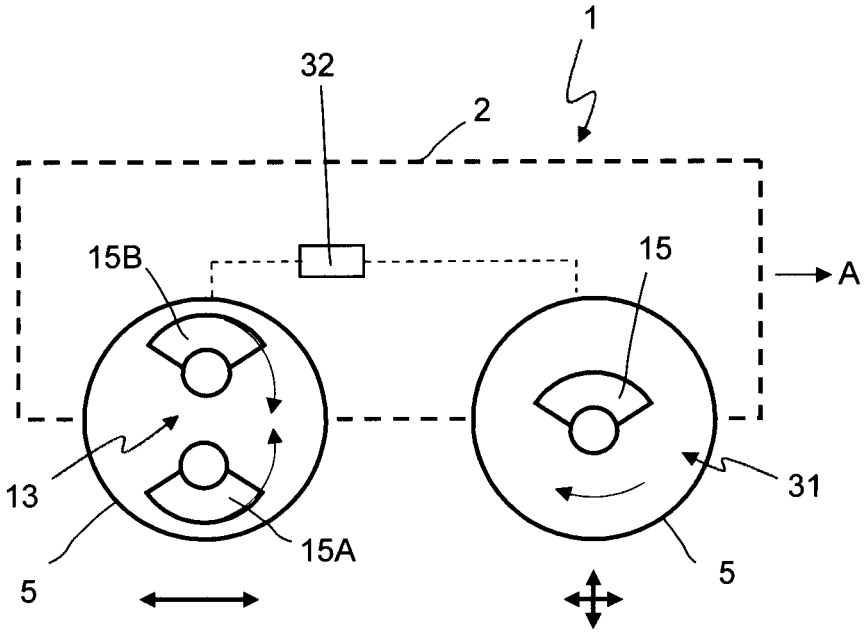
FIG. 6 is a schematic side view of a roller having two exciter units which differ with regard to their generated oscillation characteristic.

FIG. 6 resorts to the basic structure of the rollers 1 shown in FIGS. 1-3 and illustrates a modification according to which two different exciter units are provided inside the exclusively two roller drums 5 comprised by the roller. In the left roller drum 5 in FIG. 6, the exciter unit 13 is arranged in the form of a horizontal directed oscillator, as described in more detail in FIG. 4 or 5, wherein for simplification purposes merely the two imbalance weights 15A and 15B and their rotational movements in a vertical plane transverse to the rotation axis D of the two roller drums 5 are shown. The right roller drum 5 in FIG. 6, on the other hand, comprises an exciter unit 31 which acts in a different manner than the exclusively horizontal directed oscillator, said different exciter unit being in the present embodiment example a rotary exciter having exclusively one imbalance weight 15. The oscillation characteristic of this rotary exciter is characterized in that, depending on the phase, it creates an oscillation spectrum that includes oscillation components acting in vertical upward and downward directions as well as in horizontal forward and backward directions, as illustrated by the cross-arrow in FIG. 6. This exciter unit 31 is arranged inside the front roller drum 5 of the roller 1 in the forward direction A. The sum of the two exciter units 13 and 31 thus produces an oscillation characteristic of the roller 1 of FIG. 6 in which diagonally acting forces can be introduced into the underlying ground at least transitionally. The directed oscillator 31 may also be substituted by differently acting exciter units such as an oscillatory exciter, an adjustable directed oscillator, etc.

In the embodiment example according to FIG. 6, a coordination device 32 is further provided which detects the rotational/phase position and/or the rotation frequency of at least one respective imbalance weight 15A/15B and 15 (directed oscillator), for example, via suitable sensors, and controls the drive, i.e., the drive motor, of at least one exciter unit 13/31 to enable a coordinated oscillation operation of the two exciter units 13 and 31.

Figure 7:
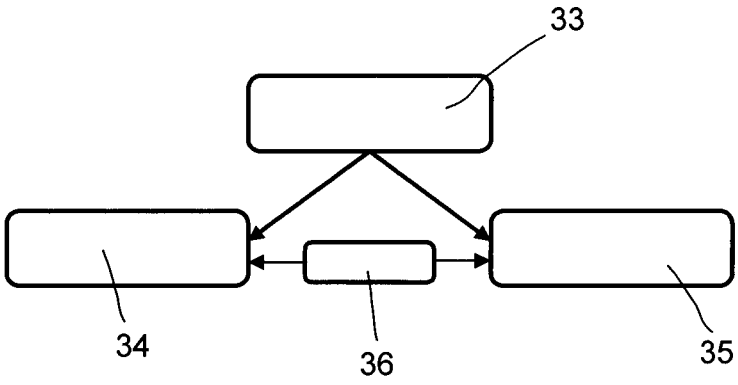
FIG. 7 is a flowchart of a method according to one embodiment of the present invention.

Finally, FIG. 7 shows a flowchart of a method according to one embodiment of the present invention. According to one embodiment, operating 33 a roller involves simultaneously generating an exclusively horizontal oscillation in a first drum according to step 34 and simultaneously generating a different type of oscillation, in particular, with a vertical component, in a second drum according to step 35. The method illustrated in FIG. 7 thus specifically refers to the embodiment example according to FIG. 6. The method according to one embodiment of the present invention is, in particular, also suitable for use in a roller 1 having a split drum as shown, for example, in FIGS. 4 and 5, in which case generating the exclusively horizontal oscillation with the horizontal directed oscillator for the split drum is performed exclusively via one single exciter unit, in particular the exciter unit 13.

Step 36 may optionally involve coordinating steps 34 and 35 with the aid of a coordination device, in particular a device as described in connection with FIG. 6, during the operation of the roller.

Generally, each of the rollers described above is particularly suitable for carrying out the method according to one embodiment of the present invention.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A ground compaction roller, comprising:

a machine frame having an operator platform;

a drive engine;

at least one first roller drum, said at least one first roller drum being mounted for rotation between two mounting arms arranged at face sides of said at least one first roller drum and connected to the machine frame; and a first exciter unit configured to generate oscillations arranged inside said at least one first roller drum, said first exciter unit comprising:

an exciter housing;

two imbalance weights mounted inside said exciter housing for rotation in opposite directions and coupled to one another, said imbalance weights rotating about two rotation axes (R1, R2) that are stationary relative to said exciter housing; and a drive motor arranged outside said exciter housing, said drive motor being in drive connection with at least one of said two rotatably mounted imbalance weights, wherein said exciter housing is connected to at least one of the two mounting arms via a rotary lock so that said exciter housing is rotationally fixed in a non-adjustable manner relative to the mounting arms, and that the two imbalance weights are coupled to one another in such a manner that amplitudes of the two imbalance weights add up in a horizontal direction.

2. The roller according to claim 1, wherein the two rotation axes (R1, R2) extend horizontally and one above the other in a vertical direction.

3. The roller according to claim 1, wherein the mounting arms each comprise an absorber stage at least between an external part and an internal part, said exciter housing being connected to said internal part in a rotationally fixed manner via a rotary lock.

4. The roller according to claim 1, wherein the at least one first roller drum is a split roller drum having two roller drum halves, and further wherein at least one of the following features is provided:

the first exciter unit extends into both roller drum halves in the axial direction of the rotation axis (D) of the at least one first roller drum;

the roller drum halves have the same extension in the axial direction of the rotation axis (D) of the at least one first roller drum; and the roller drum comprises exclusively the first exciter unit for generating oscillations.

5. The roller according to claim 1, wherein the rotary lock comprises an insert shaft extending through a drum bearing, said insert shaft being guided out of a drum interior space on a face side opposite a drive face side of said at least one first roller drum.

6. The roller according to claim 5, wherein the insert shaft is arranged between two flange plates, one flange plate being fixed to the exciter housing and the other flange plate being fixed to the mounting arm.

7. The roller (1) according to claim 1, wherein the roller has at least one second roller drum and is an articulated-steered or pivot-steered tandem roller.

8. The roller according to claim 7, wherein the at least one second roller drum comprises a second exciter unit.

9. The roller according to claim 8, wherein the second exciter unit is configured such that, compared to the first exciter unit, in which the amplitudes add up in a horizontal direction, the second exciter unit produces a different type of oscillation characteristic with at least a vertical component.

10. The roller according to claim 8, wherein the second exciter unit is a rotary exciter.

11. The roller according to claim 8, wherein a coordination device is provided which coordinates the operation of the first and second exciter units relative to one another.

12. A method for producing an oscillation characteristic of a ground compaction roller according to claim 1 comprising the following steps during a traversal of the underlying ground to be compacted:

a) generating an exclusively horizontal oscillation in a first drum; and b) generating a different type of oscillation with a vertical component, in a second drum.

13. The method according to claim 12, wherein generating the exclusively horizontal oscillation for a split roller drum having two roller drum halves is performed exclusively via one single exciter unit.

* * * * *